US005427364A

United States Patent [19]

Zborschil

[11] Patent Number: 5,427,364

[45] Date of Patent: Jun. 27, 1995

[54] SCREW CLAMP

[75] Inventor: Karl-Heinz Zborschil, Greifenstein-Beilstein, Germany

[73] Assignee: HerHof-Umwelttechnik GmbH, Germany

[21] Appl. No.: 157,370

[22] Filed: Nov. 23, 1993

[30] Foreign Application Priority Data

Nov. 27, 1992 [DE] Germany ..... 42 40 003.1

[51] Int. Cl.[6] ..... B25B 1/00

[52] U.S. Cl. ..... 269/166; 269/258; 269/249; 269/261; 269/283

[58] Field of Search ..... 269/45, 88, 249, 166–171.5, 269/283, 258, 261, 147–149, 203

[56] References Cited

U.S. PATENT DOCUMENTS

| | | | |
|---|---|---|---|
| 669,282 | 3/1901 | Lanpher | 269/166 |
| 1,403,580 | 1/1922 | Venema . | |
| 4,691,907 | 9/1987 | Yang | 269/258 |
| 4,747,590 | 5/1988 | Yang | 269/249 |
| 4,753,425 | 6/1988 | Yang | 269/45 |
| 4,834,354 | 5/1989 | Yang | 269/156 |

FOREIGN PATENT DOCUMENTS

| | | |
|---|---|---|
| 2032555 | 11/1970 | France . |
| 2651164 | 8/1989 | France . |
| 219055 | 1/1909 | Germany . |
| 3026285 | 2/1982 | Germany . |

*Primary Examiner*—Robert C. Watson
*Attorney, Agent, or Firm*—Morgan & Finnegan

[57] ABSTRACT

A screw clamp comprises a pillar (5), a backing arm (11) and a clamping arm (12), a clamping part (6) being connected with the backing arm (11) and/or with the clamping arm (12) and a respective thrust plate (7 and 8) being connected with the backing arm (11) and with the clamping arm (12) or, respectively, with the clamping part (6). In order to render it possible to exert forces on surfaces which are not parallel to each other the backing arm thrust plate (8) and/or the clamping arm thrust plate (7) are adjustable in angle, preferably because the backing arm (11) and/or the clamping arm (12) respectively consist of an arm bearing (1 and 2) and an arm shank (3 and 4) able to be turned in relation to it.

6 Claims, 3 Drawing Sheets

SCREW CLAMP

The invention relates to a screw clamp consisting of a pillar, a backing arm and a clamping arm, a clamping part being connected with the backing arm and/or with the clamping arm and a respective thrust plate being connected with the backing arm and with the clamping arm or, respectively, with the clamping part.

Such screw clamps are widely employed in practice. Normally, but not necessarily the backing arm is fixedly connected with the pillar and arranged at the end of the pillar. Normally and again not necessarily the clamping arm is able to be slid in relation to the pillar. The clamping part is normally but not necessarily joined to the clamping arm. In general with the clamping part it is a question of a screw threaded bolt, which is in engagement with a female screw thread provided on the clamping arm so that it can be moved forwards by turning. Accordingly a clamping action is produced. In order to be able to turn the screw threaded bolt it is possible to provide a rotary handle thereon. It is however furthermore possible to replace the rotary handle or grip by a polygonal end piece so that the rotation is able to be effected using a suitable polygonal spanner or key.

The thrust plates may be integrally connected with the backing arm or, respectively, with the clamping arm or, respectively, with the clamping part.

Conventional screw clamps of this type suffer from the disadvantage that they are only able to exert tension forces and that they may only set on plan-parallel surfaces extending in in parallelism to one another. Therefore forces may only be exerted on such parts as have parallel, spaced end surfaces. If it is desired to fix oblique planes in relation to one another, i.e. structures whose end surfaces are at an angle to each other, it has so far been necessary to use shim wedges adapted to the oblique planes in order not to damage the surfaces of the oblique planes. The wedges then have to have such an angle that as a final result there are parallel surfaces for the screw clamp to bear against.

One object of the invention is to provide a screw clamp of the type initially mentioned with which forces may be exerted on non-parallel surfaces as well.

In accordance with the invention this object is to be achieved since the backing arm thrust plate and/or the clamping arm thrust plate or, respectively, clamping part thrust plate is or, respectively, are able to be adjusted in angle. As a result the advantage is attained that at least one or both clamping surfaces of the screw clamp may be adjusted in its slop in relation so the tension and/or thrust axis. Accordingly it is possible to fix or hold non-parallel surfaces at a given distance apart without the use of suitable wedges adapted to the oblique setting being necessary. The screw clamp provided by the present invention may be utilized as a general purpose screw clamp. It is suitable for clamping and providing a clamping effect and a pressing effect. The working surface to be clamped may be oblique planes.

Further advantageous forms of the invention are recited in the dependent claims.

It is an advantage if the backing arm and/or the clamping arm each consist of an arm bearing and an arm shank able to be turned in relation to it. In this respect the axis of rotation of the arm shank or shanks is preferably perpendicular to the longitudinal axis of the pillar. If -as is normally the case - the clamping arm is guided for longitudinal sliding movement on the pillar, the axis of rotation of the arm shank will then also be perpendicular to the direction of sliding of the clamping arm. If - as is also normally the case - the clamping part or respectively the screw threaded bolt constituting the clamping part extends parallel to the pillar of the screw clamp, the axis of rotation of the arm shank will also extend perpendicularly to the direction of sliding of the clamping part or, respectively, of the screw threaded bolt constituting the clamping part.

Preferably both the backing arm and also the clamping arm consist of an arm bearing and an arm shank able to be turned in relation to it and the axes of rotation of the two arm shanks extending perpendicularly to the longitudinal axis of the pillar. In this case it is furthermore an advantage if both axes of rotation extend parallel to each other and are spaced apart from one another.

An other advantageous feature of the invention is such that the arm bearing or arm bearings are in the form of cylindrical bolts. The arm bearing or arm bearings may however also be in the form of polygonal bearing bolts. Accordingly the arm shanks snap into certain angular setting, which are defined by the polygonal bearing bolts. This then improves the rotational locking effect for the two arm shanks. However, the arm shanks are then not able to be steplessly adjusted in angle.

In accordance with a further advantageous development of the invention one or both of the thrust plates is connected by a ball joint with the backing arm or, respectively, the backing arm shank and/or the clamping arm or, respectively, the clamping arm shank or, respectively, the clamping part.

In keeping with a still further development of the invention the arm bearing or bearings of the cylindrical bolt(s) or bearing bolt(s) and the arm shank or shanks are held against axial sliding, preferably by means of one or more spring washer locking means.

Preferably the clamping part has a screw thread and a handle. The screw thread may be provided on a threaded bolt. Preferably the screw thread is a male screw thread, which is screwed into a corresponding female screw thread, which is provided in the backing arm and/or the clamping arm. By turning the handle the screw thread of the clamping part is screwed in relation to the corresponding screw thread of the backing arm and/or of the backing arm so that the clamping effect is produced.

The handle may be fixedly connected with the screw thread or, respectively, the screw threaded bolt. In accordance with a further advantageous development of the invention the handle may however be connected with the screw thread by a joint. This arrangement is preferably such that the handle is able to be pivoted through an angle of at least 90° in relation to the screw thread or, respectively, the screw threaded bolt. Should it be desired to apply particularly high forces, it is possible for the handle to be pivoted in relation to screw thread. The lever action that is then produced will increase the thrust moment and the pressing force accordingly. The handle is bent out of the axis of the screw thread or, respectively, of the screw threaded bolt so that the said leverage may be obtained. If there is no obstacle to a full rotation of the handle in the angled position, it is sufficient if a simple or plain joint is employed. The handle is then pivoted through a given angle of preferably 90° in relation to the axis of the screw thread. Then rotation takes place. If however a complete rotation of 360° is not possible with the handle in the fully angle setting, it is an advantage if the joint is so designed that it can be pivoted into a plurality of angle settings of the screw thread or, respectively, of the screw threaded bolt.

Advantageous developments and convenient forms of the invention will be understood from the detailed description and the accompanying drawings.

Figure 1:
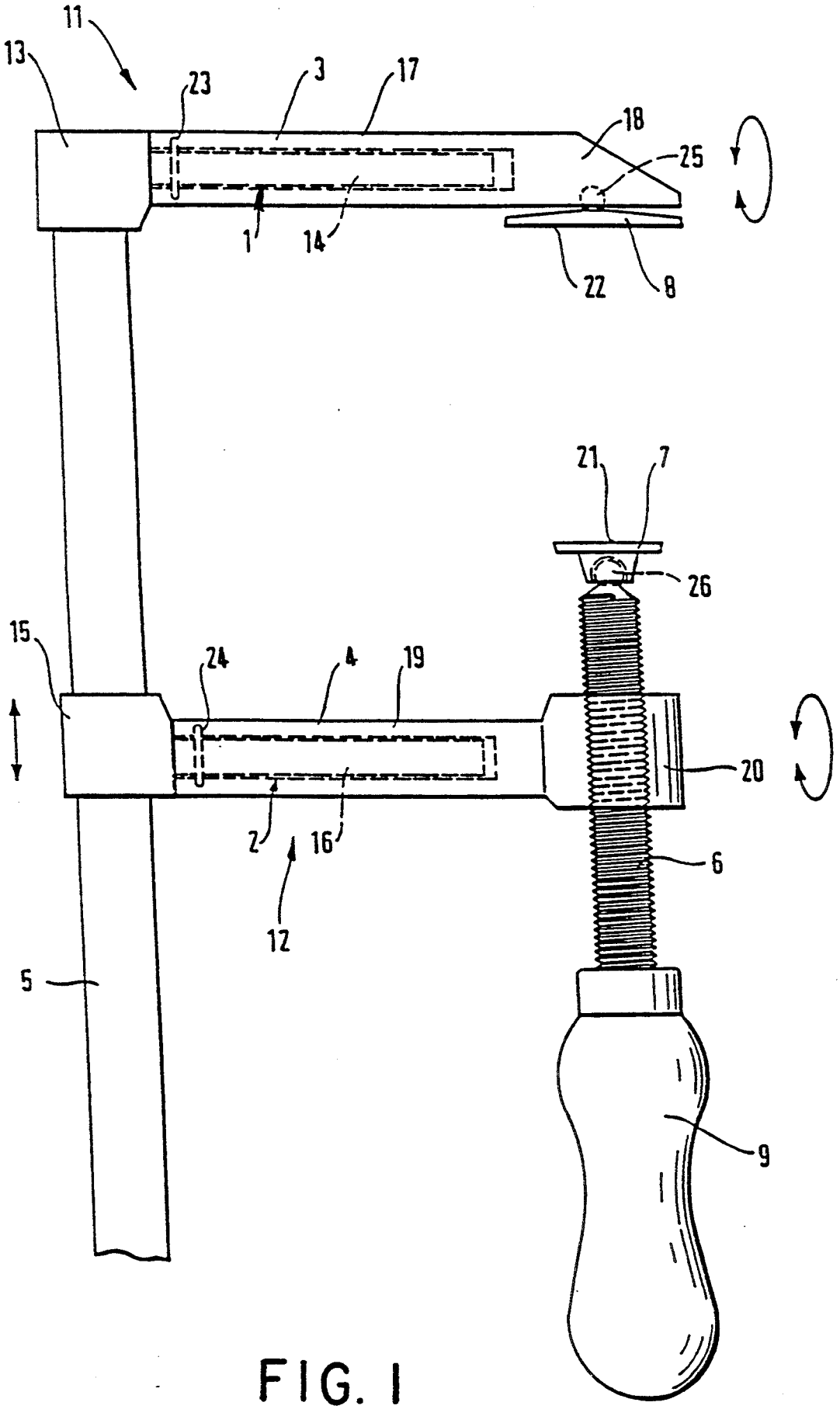
FIG. 1 shows one embodiment of the invention of the screw clamp as seen from the front.

The screw clamp depicted in FIG. 1 consists of a pillar 5, a backing arm 11, and a clamping arm 12. The backing arm 11 is fixedly connected with the pillar 5 and arranged at the end of the pillar 5. The clamping arm 12 is mounted on the pillar 5 for longitudinal sliding motion, i.e. it is able to slide in relation to the pillar 5 in a stepless fashion. A clamping part 6 is connected to the clamping arm 12 and it consists of a screw threaded bolt which is provided with a handle (knob able to be turned) 9. A thrust plate 8 is joined to the backing arm 11 and on its side facing the clamping arm 12 it has a clamping surface 22. At the end, which is nearer the backing arm 11, of the clamping part 6 consisting of a threaded bolt a thrust plate 7 is mounted, which on its side facing the backing arm 11 possesses a clamping surface 21. The thrust plate 8 is joined with the backing arm 11 and the thrust plate 7 is connected via the clamping part 6 with the clamping arm 12.

The backing arm 11 consists of a backing arm bearing 1 and a backing arm shank 3. The backing arm bearing consists for its part of a backing arm bushing 13 and a backing arm bearing pin 14. The bushing 13 is fixedly connected with the pillar 5.

The clamping arm 12 consists of the clamping arm bearing 2 and the clamping arm shank 4. The clamping arm bearing 2 consists for its part of the clamping arm bushing 15 and the clamping arm bearing pin 16. The clamping arm bushing 15 is mounted of the pillar 5 for longitudinal sliding movement.

The backing arm shank 3 is able to be rotated on the bearing pin 14 of the backing arm bearing 1 while being axially locked thereon. In a similar fashion the clamping arm shank 4 is able to rotate on the bearing pin 16 of the clamping arm bearing 2 but is not able to move axially thereon. The axial locking action is ensured by spring washer retaining means 23 and 24, which are respectively received in a groove in the bearing pins 14 and 16 and which respectively fit into an associated groove in the backing arm shank 3 and the clamping arm shank 4.

The bearing pins 14 and 16 are designed in the form of polygonal bearing pins. However it is possible as well in a manner which is not illustrated in the drawing for the bearing pins 14 and 15 to be in the form of cylindrical bearing pins or cylindrical pins.

The backing arm shank 3 consists of a backing arm shank bushing 17 and a backing arm shank end part 18. In a similar fashion the clamping arm shank 4 consists of a clamping arm shank bushing 19 and a clamping arm shank end part 20.

The bushing 17 of the backing arm shank 3 is mounted on the bearing pin 14 of the backing arm bearing 1 for rotation through 360°. In the same manner the bushing 19 of the clamping arm shank 4 is rotatably mounted on the bearing pin 16 of the clamping arm bearing 2 for turning through 360°. The axes of rotation defined by the bearing pins 14 and 16 extend in parallelism to each other and are spaced apart. These axes of rotation furthermore extend perpendicularly to the longitudinal axis of the pillar 5 and furthermore perpendicularly to the longitudinal axis of the threaded bolt constituting the clamping part 6, since the latter threaded bolt extends parallel to the pillar 5.

The thrust plate 8 is arranged on the side of the end part 18 of the backing arm shank 3 facing the clamping arm 12. This thrust plate 8 is connected here via a ball joint 25 with the end part 18 of the backing arm shank 3.

The thrust plate 7 is mounted at the end, which is nearer the backing arm 11, of the threaded bolt. constituting the clamping part 6. At this position the thrust plate 7 is connected by means of a ball joint 26 with the clamping part 6.

The threaded bolt constituting the clamping part 6 possesses an external screw thread, which is in engagement with a female screw thread which is provided in the end part of the clamping arm shank 4. At the end remote from the backing arm 11 of the threaded bolt 6 a handle (turning knob) 9 is fixedly connected. By turning this handle 9 it is possible for the threaded bolt 6 and with it the thrust plate 7 to be moved towards the thrust plate 8. The handle or turning knob 9 may also be replaced by a polygonal head (not illustrated), to which a suitable polygonal wrench could be applied in order to produce a rotary motion thereof. Accordingly larger forces could be applied.

Figure 2:
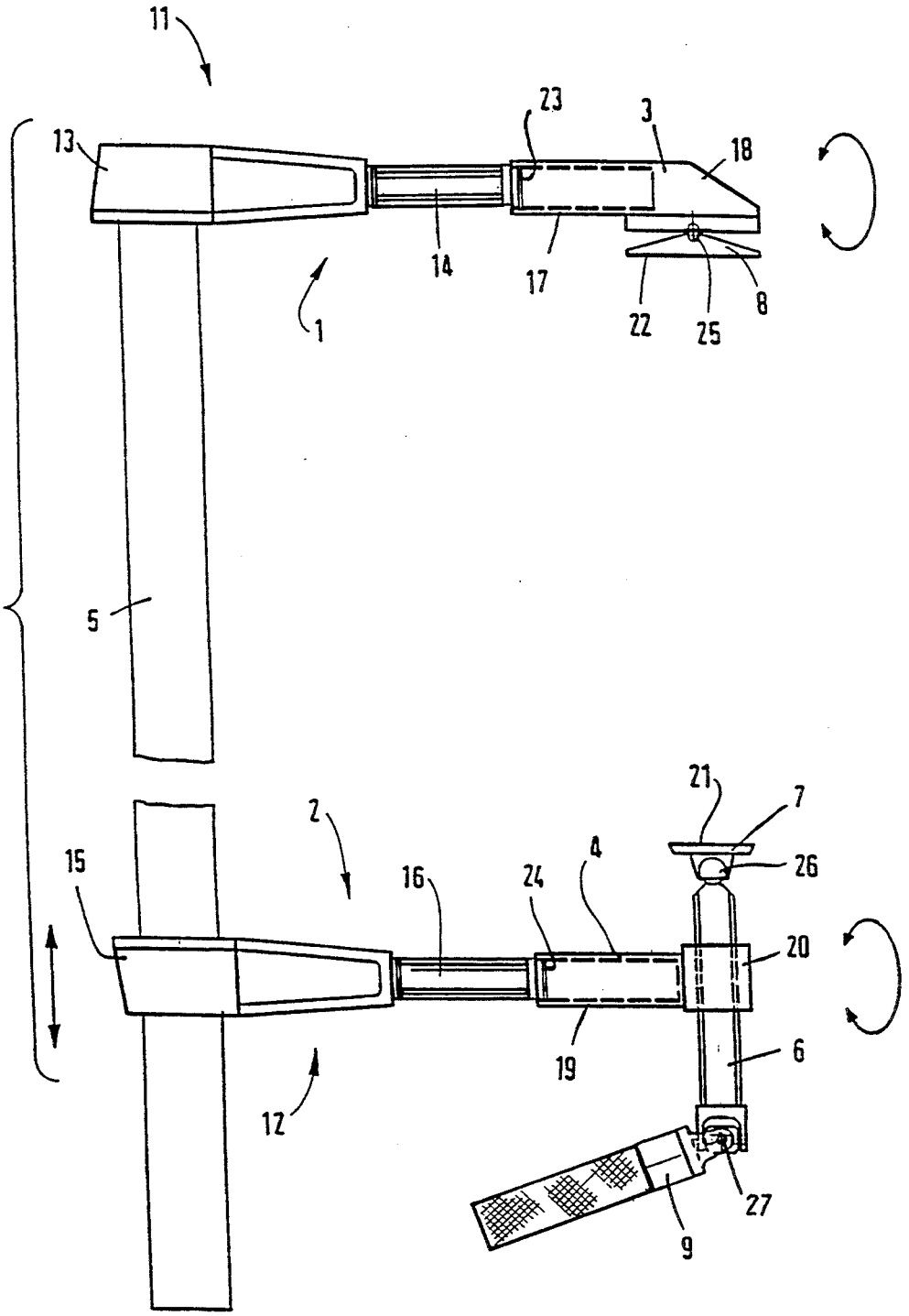
FIG. 2 is a modification of the working embodiment illustrated in FIG. 1 with a joint between the screw thread and the handle.
Figure 3:
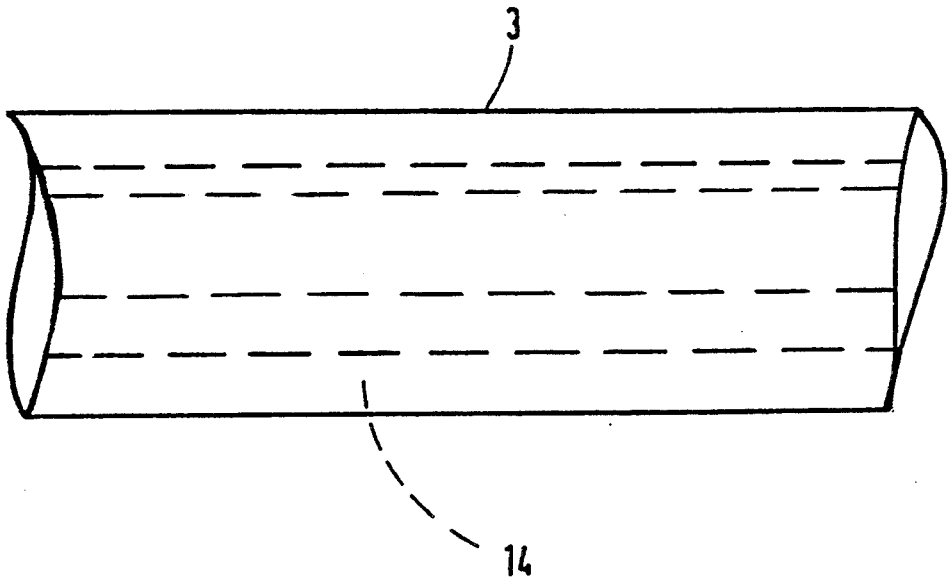
FIG. 3 is a portion of the backing arm shank illustrating the polygonal bolt.

In the case of the working embodiment illustrated in FIG. 2 a joint 27 is provided between the threaded bolt 6 and the handle 9. By means of this joint 27 the handle 9 may be sloped in relation to the longitudinal axis of the threaded bolt 6 through an angle of more than 90°. The handle connected by the joint 27 with the threaded bolt 6 is able to be folded outwards in this manner. Accordingly there is a lever effect, by which a higher thrust moment and consequently a higher pressing force can be applied.

In the case of the joint 27 it is a question of a universal joint. The threaded bolt 6 is connected with a first rotary shaft, which extends in parallelism to the arm shank 4. On this first rotary shaft a second shaft is rotatably bearinged, which extends perpendicularly to it and is provided with the handle 9. It is in this manner that the handle 9 can be pivoted not only in the fashion indicated in FIG. 2 to the left but furthermore when required through 90° to the right. It is then possible to actuate the threaded bolt 6 also when the outwardly pivoted handle 9 is obstructed and may not be rotated through 360° but merely through 180°. Then after each turn of the threaded bolt 6 through 180° the handle 9 can be also pivoted through 180° into the other position thereof; in this setting the threaded bolt 6 is then again able to be turned.

Owing to the rotatability of the arm shanks 3 and 4 in relation to the arm bearings 1 and 2 both the backing arm thrust plate 8 and also the clamping arm thrust plate or, respectively, the clamping part thrust plate 7 can be adjusted in angle. The arm shanks 3 and 4 having the thrust plates 7 and 8 and the clamping surfaces 21 and 22 are able to be turned through 360° in relation to the axis of the pillar 5. The axes of rotation are defined by the bearing pins 14 and 16. Owing to the spring washer retaining means 23 and 24 axial displacement is prevented. The spring washer retaining means 23 and 24 can be constituted by a ring mounted in a groove in each case. Such spring ring may be firstly mounted in a groove in the bearing pin 14 or 16, in which it is compressed by a tool so that its outer periphery no longer extends proud of the outer periphery of the bearing pin 14 or, respectively, 16. In this position the arm shank 3 or 4 is slipped over the spring ring. The arm shank 3 or 4 is then pushed along again until the internal groove provided in it reaches the spring ring. In this position the spring ring will move outwards owing to its elasticity and the axial securing means between the bearing pin 14 and the arm shank 3 or, respectively, bearing pin 16 and the arm shank 4 is obtained. Assembly may also be so performed that the spring ring is firstly slipped into the internal groove provided in the arm shank 3 or 4 and in this setting is then compressed to such an extent that its inner circumference is equal to or larger than the inner periphery of the hole in the arm shank 3 or 4. In this setting the arm shank 3 or 4 is then mounted on the associated bearing pin 14 or 16 and pushed along farther until the spring ring reaches the outer groove on the bearing pin 14 or 16 and snaps into it so that there is now a means preventing axial sliding displacement.

In order for surfaces to be able to be clamped together as well which are not only parallel but also furthermore may also assume a further oblique setting in their parallel position, the thrust plates 7 and 8 are connected with the arm shanks 3 and 4 by the intermediary of the ball joint pins or, respectively, ball joints 25 and 26 with the arm shanks 3 and 4.

The screw clamp as described and illustrated can be employed to apply both tension and also thrust forces on work. In the setting depicted in FIGS. 1 and 2 compressive or thrust forces can be exerted on work by the screw clamp. If both the backing arm shank 3 and also the clamping arm shank 4 are turned around the backing arm bearing 1 or, respectively, the clamping arm bearing 2 through 180° in each case, the thrust plates 8 and 7 will be directed away from each other so that tension forces can be exerted on a piece of work. The screw clamp consists of a pillar or back member 5 with two bearings 1 and 2 and two arm shanks 3 and 4 able to be turned in these bearings, the arm shanks 3 and 4 carrying the bearing plate and, respectively, thrust plates 7 and 8.

I claim:

1. A screw clamp comprising a pillar, a rotatable backing arm and a rotatable clamping arm, a clamping part being connected with the backing arm and selectively with the clamping arm and thrust plates each respectively connected with the backing arm and with the clamping part comprising:

the backing arm thrust plate and the clamping part thrust plate are angularly adjustable;

the backing arm and the clamping arm each have an arm bearing and an arm shank, the backing arm shank and the clamping arm shank being each rotatable relative to their respective arm bearings, at least one or the arm bearings being in the form of a polygonal bearing pin; and spring washer means for the arm bearings and arm shanks for each of said respective backing and clamping arms to prevent relative axial motion therebetween.

2. The screw clamp as claimed in claim 1, further comprises the axis of rotation for each of said arm shanks extending perpendicularly to the pillar.

3. The screw clamp as claimed in claim 1 comprising at least one thrust plate connected by means of a ball joint with at least one of the backing arm and the clamping part.

4. The screw clamp as claimed in claim 1, wherein the clamping part further comprises a screw thread and a handle.

5. The screw clamp as claimed in claim 4, wherein the handle is connected to the screw thread by means of a joint.

6. A screw clamp comprising a pillar, a rotatable backing arm and a rotatable clamping arm, a clamping part being connected with the backing arm and selectively with the clamping arm and thrust plates each respectively connected with the backing arm and with the clamping part comprising:

the backing arm thrust plate and the clamping part thrust plate are angularly adjustable;

the backing arm and the clamping arm each have an arm bearing and an arm shank, the backing arm shank and the clamping arm shank being each rotatable relative to their respective arm bearings, at least one of the arm bearings being in the form of a cylindrical bearing pin; and spring washer means for the arm bearings and arm shanks for each of said respective backing and clamping arms to prevent relative axial motion therebetween.

* * * * *